US008122742B2

(12) United States Patent
Park

(10) Patent No.: US 8,122,742 B2
(45) Date of Patent: Feb. 28, 2012

(54) WASHING DEVICE AND METHOD CONTROLLING THE SAME

(75) Inventor: Seog Kyu Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 691 days.

(21) Appl. No.: 11/628,322

(22) PCT Filed: Feb. 27, 2006

(86) PCT No.: PCT/KR2006/000667

§ 371 (c)(1),
(2), (4) Date: Sep. 27, 2007

(87) PCT Pub. No.: WO2006/101312

PCT Pub. Date: Sep. 28, 2006

(65) Prior Publication Data

US 2010/0058544 A1 Mar. 11, 2010

(30) Foreign Application Priority Data

Mar. 25, 2005 (KR) ..... 10-2005-0025102

(51) Int. Cl.
*D06F 39/04* (2006.01)

(52) U.S. Cl. ..... 68/15; 68/207

(58) Field of Classification Search ..... 68/5 R, 68/5 C, 12.21, 12.27, 15, 207
See application file for complete search history.

(56) References Cited

U.S. PATENT DOCUMENTS

| | | | | |
|---|---|---|---|---|
| 3,805,561 | A * | 4/1974 | Bullock | 68/5 C |
| 2004/0187527 | A1 * | 9/2004 | Kim et al. | 68/5 C |
| 2004/0187529 | A1 | 9/2004 | Kim et al. | |
| 2005/0034249 | A1 * | 2/2005 | Oh et al. | 8/159 |
| 2005/0034250 | A1 * | 2/2005 | Oh et al. | 8/159 |
| 2005/0034487 | A1 * | 2/2005 | Oh et al. | 68/5 C |
| 2005/0034489 | A1 * | 2/2005 | Oh et al. | 68/5 C |
| 2005/0092035 | A1 * | 5/2005 | Shin et al. | 68/275 |
| 2006/0016020 | A1 * | 1/2006 | Park | 8/158 |
| 2006/0191078 | A1 * | 8/2006 | Kim et al. | 8/159 |

FOREIGN PATENT DOCUMENTS

| | | | |
|---|---|---|---|
| CN | 1580357 | A | 2/2005 |
| CN | 1580369 | A | 2/2005 |
| DE | 3627988 | A1 | 4/1987 |
| EP | 1464751 | A1 | 10/2004 |
| EP | 1507029 | A2 | 2/2005 |
| EP | 1507031 | A1 | 2/2005 |
| EP | 1507032 | A1 | 2/2005 |
| EP | 1785519 | A2 | 5/2007 |

* cited by examiner

*Primary Examiner* — Joseph L Perrin
(74) *Attorney, Agent, or Firm* — McKenna Long & Aldridge LLP

(57) ABSTRACT

A washing machine having a steam generator, which generates steam so that the steam is used in a washing or drying operation, and a method for controlling the same are disclosed. The steam generator includes a case having a space for storing water; a heater provided in the space of the case for generating heat; and a water level sensor for sensing the minimum and maximum level of the water stored in the space of the case. A controller controls the water supply valve and the heater according to a result sensed by the water level sensor. The water supply valve is opened and closed, thereby controlling the supply of water to the steam generator.

14 Claims, 6 Drawing Sheets

[Fig. 1]
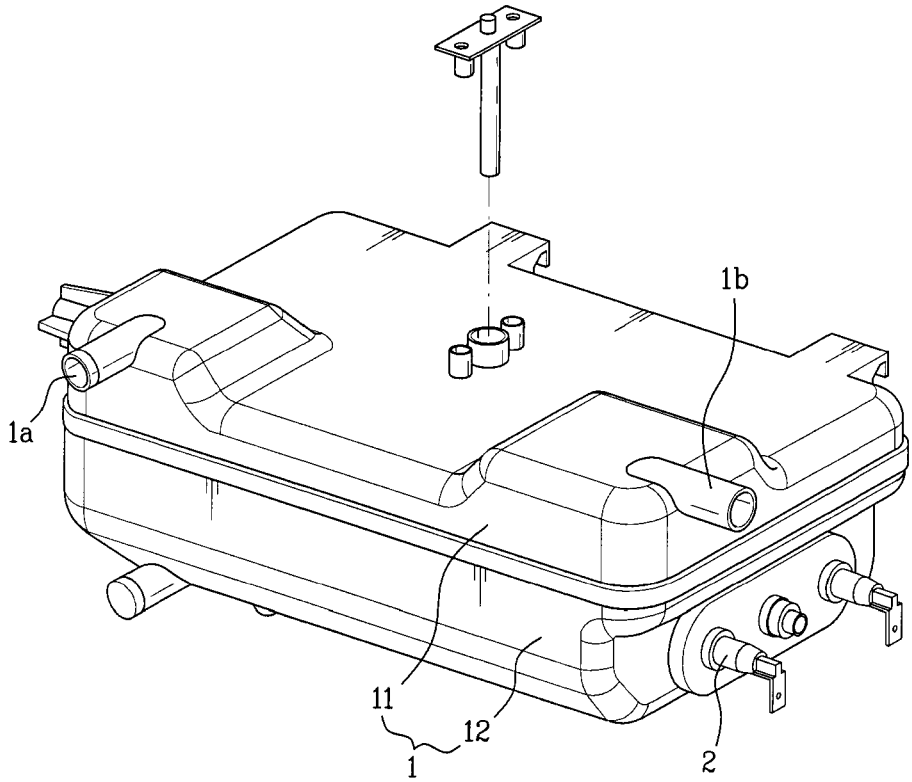
[Fig. 2]
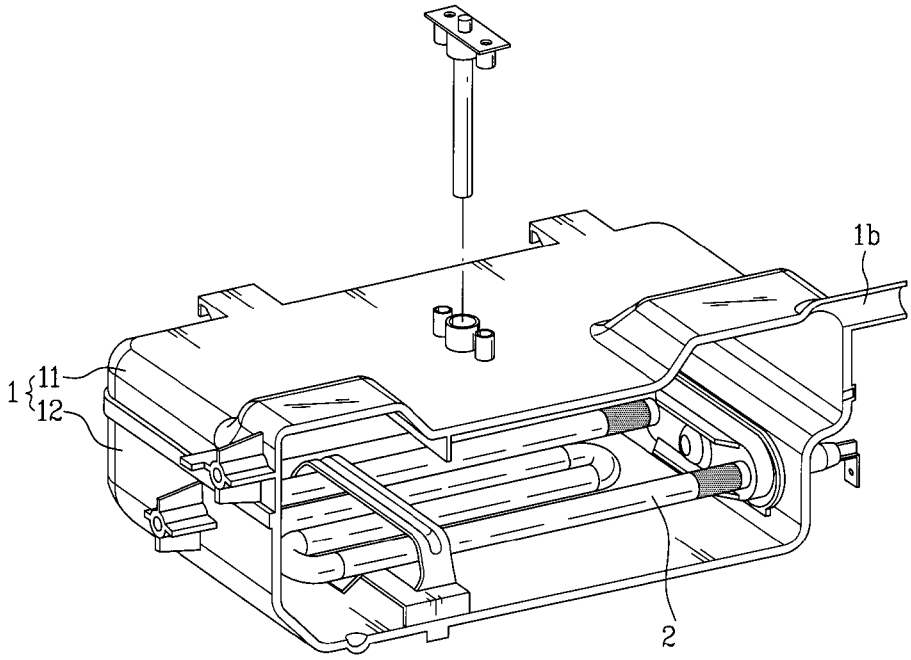

[Fig. 3]
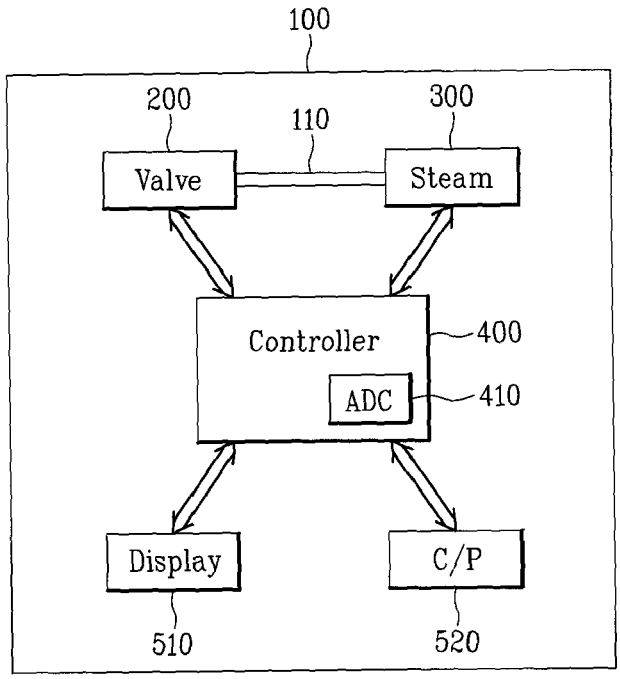
[Fig. 4]
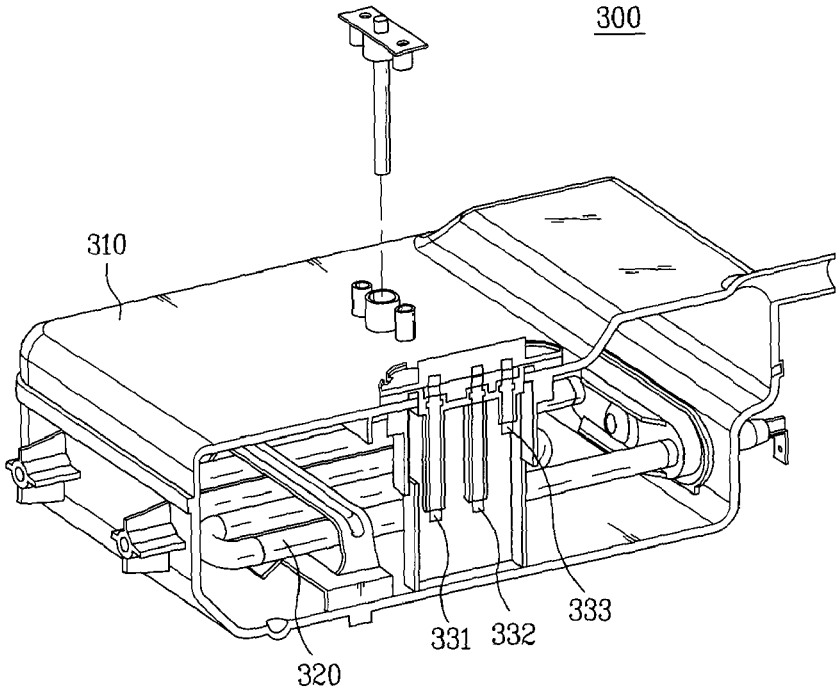

[Fig. 5]
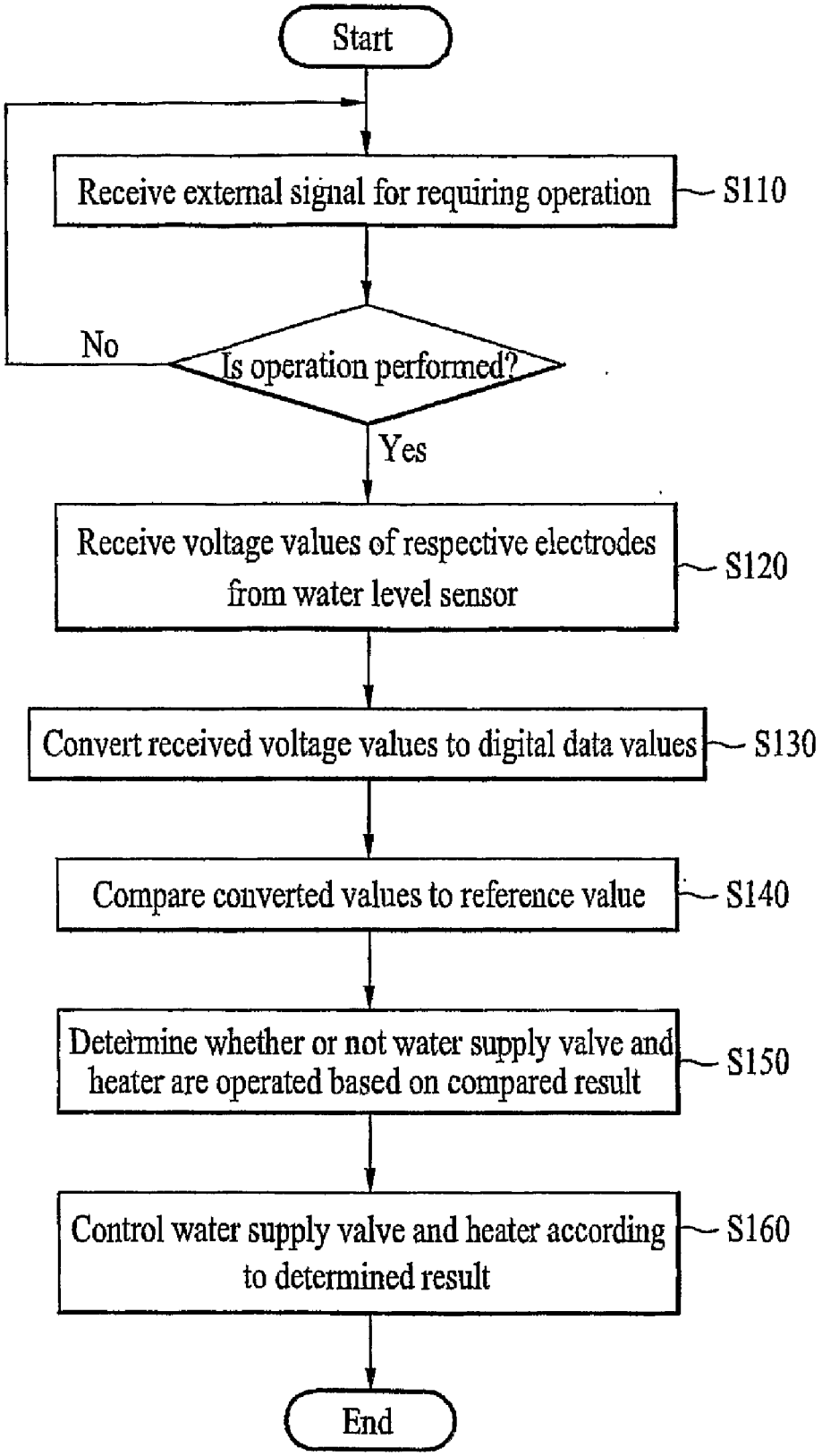

[Fig. 6]
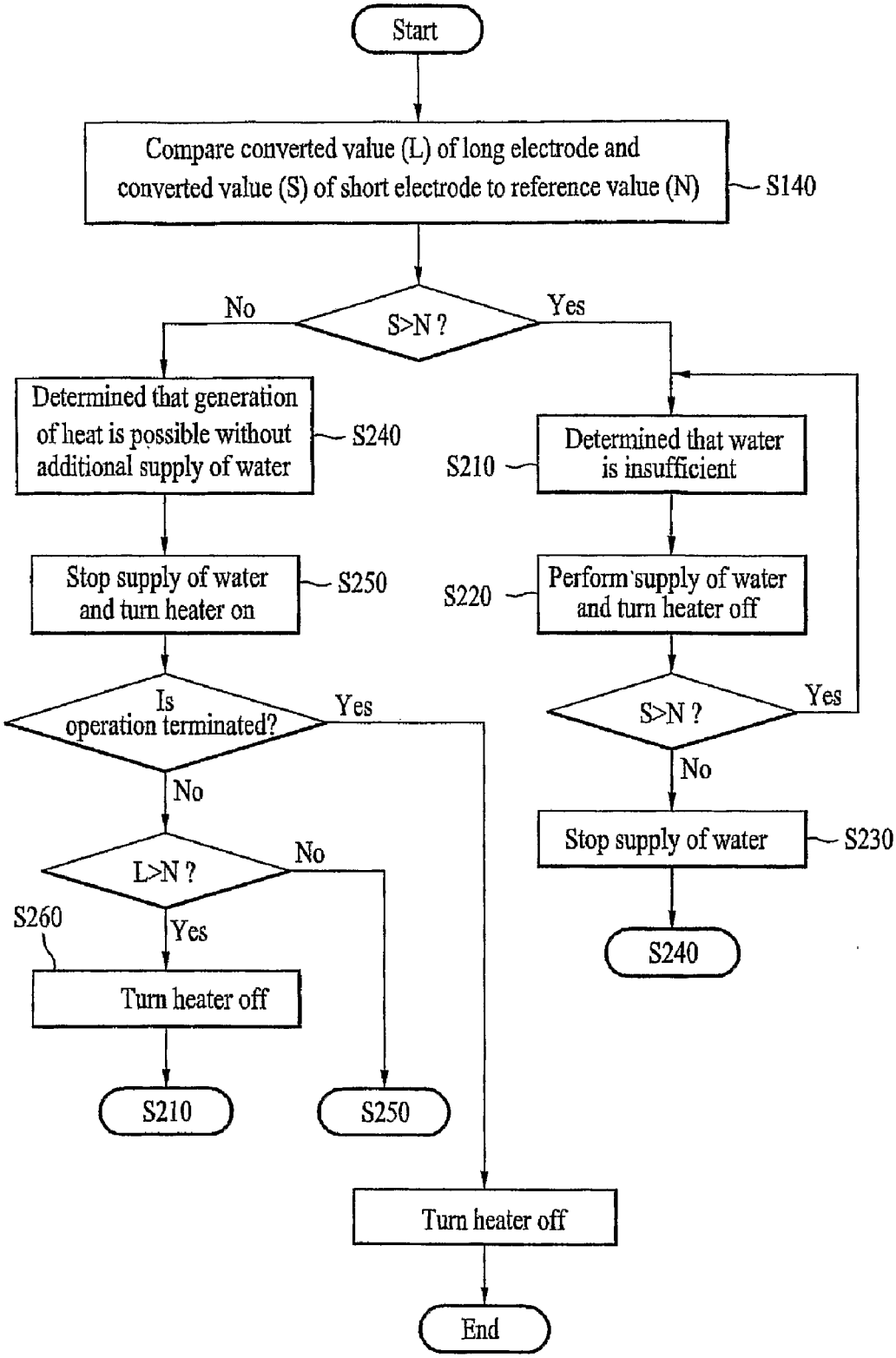

[Fig. 7]
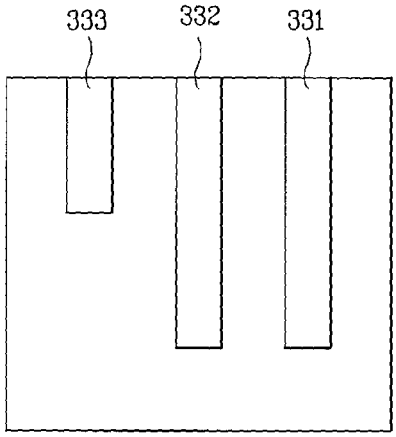
[Fig. 8]
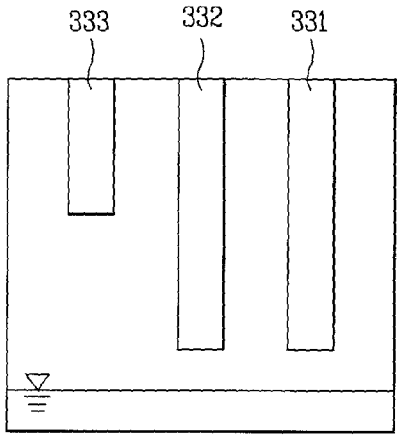
[Fig. 9]
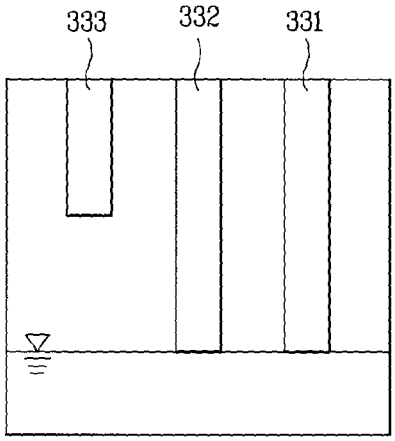

[Fig. 10]
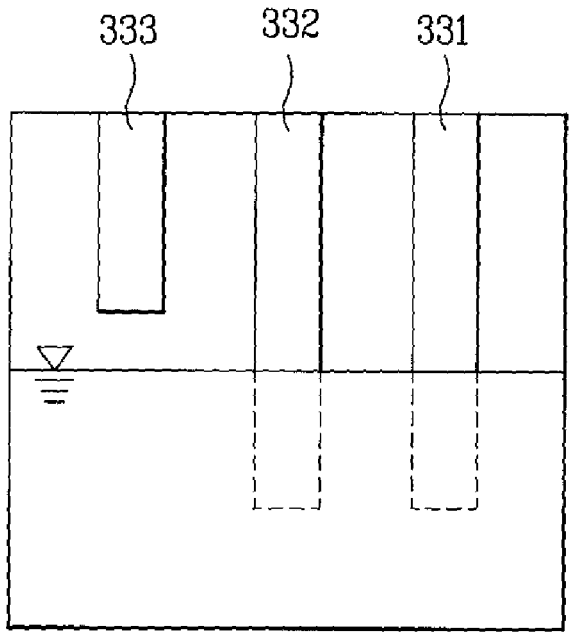
[Fig. 11]
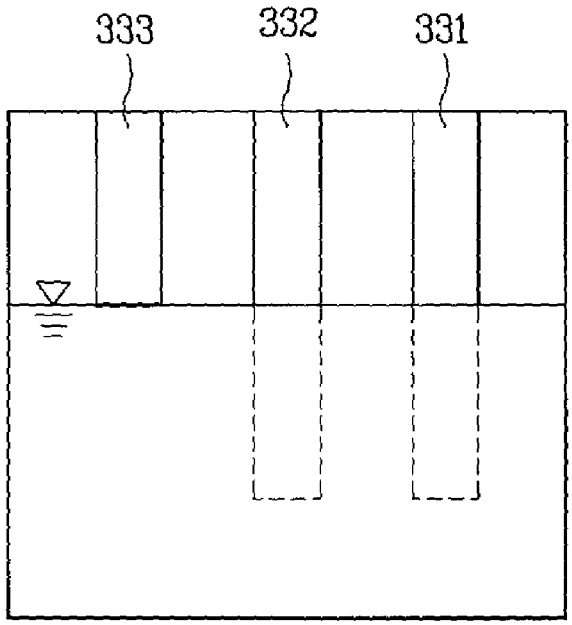

WASHING DEVICE AND METHOD CONTROLLING THE SAME

This application claims priority to International application No. PCT/KR2006/000667 filed on Feb. 27, 2006, Korean Application No. 10-2005-0025102 filed on Mar. 25, 2005, both of which are incorporated by reference, as if fully set forth herein.

TECHNICAL FIELD

The present invention relates to a washing machine, and higher particularly, to a steam generator for a washing machine, which generates steam so that the steam is used in a washing or drying operation.

BACKGROUND ART

Generally, washing machines include a pulsator washing machine in which a drum is vertically erected, a drum washing machine in which a drum is horizontally laid, a drying and washing machine having drying and washing functions, and a drying machine having only a drying function.

Among the washing machines, the pulsator washing machine, the drum washing machine, and the drying and washing machine perform a washing operation using washing water.

In the washing operation, a large amount of washing water is required. Accordingly, various attempts to minimize the amount of the washing water used to wash laundry are currently being investigated.

For this reason, a steam generator is provided. The steam generator assists the washing operation so that the washing operation is performed using a small amount of washing water.

Hereinafter, with reference to FIGS. 1 and 2, a conventional steam generator for a washing machine will be described in detail.

As shown in FIGS. 1 and 2, the conventional steam generator comprises a case 1, and a heater 2.

The case 1 defines the external appearance of the steam generator, forms a space for storing water required to generate steam, and comprises an upper case 11 forming the upper portion of the case 1 and a lower case 12 forming the lower portion of the case 1.

A water supply pipe 1*a* connected to a water supply channel (not shown) of the washing machine is formed at one side of the case 1, and a steam discharge pipe 1*b* connected to a steam supply pipe (not shown) for supplying steam generated in the case 1 by evaporation to the inside of a drum of the washing machine is formed at the other side of the case 1.

The heater 2 is installed in the horizontal direction in the lower portion of the case 1.

The heater 2 is a sheath heater, and two terminals of the heater 2 are exposed from one side of the case 1 to the outside.

The heater 2 serves to generate heat to evaporate water stored in the case 1.

Accordingly, when the steam generator is operated, the heater 2 generates heat, and thus evaporates water stored in the case 1. Steam obtained by the evaporation of the water is discharged to the outside through the steam discharge pipe 1*b*, and is supplied to the inside of a drum (not shown) of the washing machine, thereby performing various operations using the steam.

The selective generation of heat from the heater 2 and the supply of water into the case 1 in the above conventional steam generator must be performed only at a point of time when these operations are possible.

Here, the point of time means a state in which a sufficient amount of water is supplied to the inside of the case 1.

The conventional steam generator does not have a separate device for correctly measuring the supply amount of water in the steam generator according to respective states, but only has a water level sensor for detecting whether or not water exists in the steam generator.

The washing machine having the conventional steam generator is operated when water exists in the steam generator regard lower of the supply amount of the water in the steam generator. Accordingly, during the operation of the steam generator, a lack of water occurs and the heater 2 is exposed to external air.

Thereby, the temperature in the case 1 rapidly increases, and the case 1 is deformed and contacts the heater 2, thus causing danger of a fire.

DISCLOSURE OF INVENTION

Technical Problem

An object of the present invention devised to solve the problem lies on a washing machine having a steam generator, in which the correct amount of water supplied to the inside of a case is sensed so that operations of various components for generating steam can be controlled using the sensed value, and a method for controlling the same.

Technical Solution

The object of the present invention can be achieved by providing a washing machine comprising a steam generator comprising a case having a space for storing water; a heater provided in the space of the case for generating heat; and a water level sensor for sensing the minimum and maximum level of the water stored in the space of the case.

A controller controls the water supply valve and the heater according to a result sensed by the water level sensor. The water supply valve is opened and closed, thereby controlling the supply of water to the steam generator.

Here, instead of sensing the maximum water level and the minimum water level, the water level sensor may sense whether or not the level of the water is lower than the minimum water level or higher than the maximum water level. Further, the water level sensor may be operated such that both methods are possible.

Preferably, the minimum water level may be a level of water, which exposes the heater from the surface of the water. That is, preferably, the minimum water level may be set to be equal to or lower than the level of water, which exposes the heater from the surface of the water.

Preferably, when it is sensed that the water level is equal to or lower than the minimum water level, the operation of the heater is stopped.

Preferably, the maximum water level is a level of water, which is maximally contained in the space of the case. Preferably, when it is sensed that the water level is equal to or higher than the maximum water level, the water supply valve is closed.

Preferably, the controller closes the water supply valve when a water supply time counted after the start of the supply of water reaches a designated time. Thereby, it is possible to prepare for a defect of the water level sensor.

Higher preferably, the controller closes the water supply valve and operates a warning device to notify a user of the defect of the water level sensor, when the result sensed by the water level sensor is not higher than the maximum water level although the counted water supply time exceeds the designated time.

The warning device may have various shapes. For example, the warning device is a buzzer for sounding an alarm, a lamp, or an LCD for displaying the defect.

Preferably, the controller starts the operation of the heater only when the result sensed by the water level sensor is equal to or higher than the maximum water level. Then, the controller stops the operation of the heater when a heater operating time counted after the start of the operation of the heater reaches a designated time. Thereby, it is possible to prepare for a defect of the water level sensor.

Higher preferably, the controller stops the operation of the heater and operates the warning device to notify a user of the defect of the water level sensor, when the result sensed by the meter level sensor is not lower than the minimum water level although the heater operating time counted after the start of the operation of the heater exceeds the designated time.

The water level sensor comprises a long electrode, a terminal of which is exposed to a height corresponding to the minimum water level; a common electrode, a terminal of which is exposed to a height corresponding to or below the minimum water level; and a short electrode, a terminal of which is exposed to a height corresponding to the maximum water level.

The water level sensor has various water level sensing methods. For example, voltages values of the short and long electrodes based on the common electrode may be used, or whether or not the common electrode is electrically connected to the long or short electrode may be used.

In a further aspect of the present invention, provided herein is a washing machine comprising a main body forming the external appearance of the washing machine; a water supply valve provided in a water supply channel in the main body; a steam generator provided in the main body, and comprising a case having a space for generating steam, a heater provided in the space of the case for generating heat, and a water level sensor comprising a common electrode, a terminal of which is exposed to a height at which the heater is completely submerged in water, a long electrode, a terminal of which is exposed to the same height as that of the terminal of the common electrode, and a short electrode, a terminal of which is exposed to a height corresponding to the maximum level of water required to generate the steam; and a controller comprising a converter for converting a value sensed by the water level sensor into a digital data value, comparing the digital data value converted by the converter to a predetermined reference value, and controlling the operation of the water supply valve and the generation of heat from the heater based on a compared result.

In another aspect of the present invention, provided herein is a method for controlling a washing machine comprising confirming whether or not an external signal for controlling operations of a water supply valve and a heater is applied; sensing a voltage value of a long electrode or a short electrode using a water level sensor of a steam generator when it is confirmed that the external signal is applied; converting the voltage value into a digital data value and comparing the converted value to a predetermined reference value; and determining whether or not the water supply valve and the heater are operated according to a compared result, and controlling the operations of the water supply valve and the heater based on a determined result.

In yet another aspect of the present invention, provided herein is a method for controlling a washing machine having a steam generator comprising confirming whether or not a common electrode is electrically connected to a long electrode or a short electrode; and controlling a water supply valve or a heater according to a confirmed result.

Advantageous Effects

In the washing machine and the method for controlling the same of the present invention, it is possible to correctly measure the amount of water existing in the steam generator.

That is, since a current water level is correctly detected using voltage values of respective electrodes sensed by the water level sensor, the water supply valve and the heater are correctly controlled.

Particularly, although the water level sensor is out of order, the supply of water or the generation of heat is automatically stopped according to the total water supply time or the total heat generating time, thereby improving the stability of the steam generator.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a perspective view of a conventional steam generator for a washing machine;

FIG. 2 is an exploded perspective view illustrating the internal structure of the conventional steam generator;

FIG. 3 is a block diagram illustrating a washing machine in accordance with an embodiment of the present invention;

FIG. 4 is an exploded perspective view illustrating the internal structure of a steam generator for the washing machine in accordance with the embodiment of the present invention;

FIGS. 5 and 6 are flow charts illustrating a method for controlling the washing machine in accordance with the embodiment of the present invention; and FIGS. 7 to 11 are schematic views of a water level sensor for illustrating the method for controlling the washing machine in accordance with the embodiment of the present invention.

BEST MODE FOR CARRYING OUT THE INVENTION

Reference will now be made in detail to the preferred embodiment of the present invention, examples of which are illustrated in the accompanying drawings.

Hereinafter, with reference to FIGS. 3 to 11, a washing machine and a method for controlling the same in accordance with a preferred embodiment of the present invention are descried in detail.

FIG. 3 is a block diagram illustrating a washing machine in accordance with the embodiment of the present invention.

As shown in FIG. 3, the washing machine in accordance with the embodiment of the present invention comprises a main body 100, a water supply valve 200, a steam generator 300, and a controller 400.

The main body 100 of the washing machine forms the external, appearance of the washing machine.

The water supply valve 200 of the washing machine is provided in a water supply channel 110 in the main body 100, and selectively opens and closes the water supply channel 110.

Here, the water supply channel 110 serves to guide the supply of water, which is used to generate steam, to the steam generator 300.

The steam generator 300 of the washing machine is provided in one space in the main body 100, and serves to generate steam by evaporating the water supplied through the water supply channel 110.

The steam generator 300, as shown in FIG. 4, comprises a case 310, a heater 320, and a water level sensor 330.

The case 310 is a rectangular box for forming the external appearance of the steam generator 300 and forming a space in which steam is generated.

The heater 320 is provided in the case 310, and serves to evaporate water stored in the case 310 by generating heat.

The water level sensor 330 comprises three electrodes, such as a common electrode 331, a long electrode 332, and a short electrode 333, and serves to sense a water level in the case 310.

The common electrode 331 and the long electrode 332 are installed such that terminals of the common electrode 331 and the long electrode 332 are exposed at a height corresponding to the minimum level of water necessary to generate steam, and the short electrode 333 has a shorter length than those of the common electrode 331 and the long electrode 332 and is installed such that a terminal of the short electrode 333 is exposed at a height corresponding to the maximum level of the water necessary to generate steam.

The height, at which the terminals of the long electrode 332 and the common electrode 331 are exposed, is a height, at which the heater 320 is completely submerged in water.

The controller 400 of the washing machine is provided in the main body 100, and controls the operations of various driving units of the washing machine, the operation of the water supply valve 200, and the generation of heat from the heater 320 of the steam generator 300.

Particularly, the controller 400 comprises an analog-digital converter (ADC) 410 for converting a value sensed by the water level sensor 330 of the steam generator 300 into a digital data value. The controller 400 compares the digital data value (hereinafter, referred to as a "converted value", which is converted by the ADC 410, to a predetermined reference value, and controls the operation of the water supply valve 200 and the generation of heat from the heater 320 based on the compared result.

The above washing machine in accordance with the embodiment of the present invention may be a drum washing machine exclusively having a washing function, a drum washing machine having washing and drying functions, or a drying machine.

The washing machine in accordance with the embodiment of the present invention further comprises a control panel (C/P) 510 allowing a user to manipulate various operations, and a display unit 520 displaying the manipulated operations and various states of the washing machine.

Hereinafter, with reference to FIGS. 4 and 5, a method for controlling the washing machine having the steam generator 300 in accordance with the embodiment of the present invention is descried in higher detail.

First, the controller 400 of the washing machine confirms whether or not an external signal for selecting various operations is supplied from a user through the C/P 510 (S110).

During the above process, when the user performs the selection for controlling the operation of the steam generator 300 so as to operate steam washing, steam rinsing, or steam sterilizing, the controller 400 receives a signal generated by the above selection.

In this case, the controller 400 controls the water level sensor 330 of the steam generator 300 so that the water level sensor 330 senses a water level in the case 310, and then receives sensed values from the water level sensor 330 (S120).

Here, the sensed values are voltage values of the long electrode 332 and the short electrode 333.

The controller 400 converts the received voltage values of the long electrode 332 and the short electrode 333 into digital data values using the ADC 410 (S130), and confirms the converted values.

Here, the controller 400 compares the converted values to a predetermined reference value (S140).

For example, on the assumption that the reference value is 150, the controller 400 determines whether or not the converted values of the long electrode 332 and the short electrode 333 are larger than, equal to, or smaller than 150.

Thereafter, the controller 400 determines whether or not the water supply valve 200 is operated and the heater 320 is operated based on the compared result (S150), and performs the control according to the determined result (S160).

Hereinafter, with reference to FIGS. 7 to 11, the step S150 and the step S160 are described in higher detail.

First, as the compared result, when the converted values (S) of the short electrode 333 is larger than the reference value (N), the controller 400 determines that the amount of water in the case 310 of the steam generator 300 is insufficient (S210). This state is illustrated in FIGS. 7 to 10.

Of course, as shown in FIGS. 7 and 8, when the converted value (L) of the long electrode 332 and the converted value (S) of the short electrode 333 are larger than the reference value (N), the controller 400 determines that the amount of water in the case 310 of the steam generator 300 is insufficient.

Thereby, the controller 400 opens the water supply valve 200 so that water is supplied to the steam generator 300. At this time, the controller 400 does not operate the heater 320.

Accordingly, water is supplied to the steam generator 300 through the water supply channel 110 of the main body 100 of the washing machine, and the heater 320 is maintained in an OFF state (S220).

During the supply of water, the controller 400 continuously compares the converted values (L and S) of the long and short electrodes 332 and 333 to the reference value (N), and, when the converted value (S) of the short electrode 333 is smaller than the reference value (N), the controller 400 closes the water supply valve 200 so that the supply of water is stopped (S230). This state is illustrated in FIG. 11.

However, in the case that the water level sensor 330 malfunctions or is out of order, it is confirmed that the converted value (S) of the short electrode 333 and/or the converted value (L) of the long electrode 332 are/is larger than the reference value (N).

Accordingly, it is preferable that the controller 400 counts the time during the above water supply process.

That is, most preferably, when the converted value of at least one of the electrodes 332 and 333 does not vary until a water supply time obtained by the above time count exceeds a designated time, the water supply valve 200 is closed so that the supply of water is stopped.

Here, the designated time is a time to supply water to a full water level in the case 310, i.e., a position at which the short electrode 333 is located, when the water is supplied to the inside of the case 310 under the condition that the water supply valve 200 is opened, and was obtained from conventional experiments.

Particularly, it is possible to confirm whether or not the water level sensor 330 is defective through the above series of the processes.

That is, when only the converted value of the short electrode 333 varies until the water supply time exceeds the designated time, it is determined that the long electrode 332 is defective, and when only the converted value of the long electrode 332 varies, until the water supply time exceeds the designated time, it is determined that the short electrode 333 is defective.

Preferably, when the defect of the water level sensor 330 is detected, an error message indicating the defect of the water level sensor 330 is displayed on the display unit 520, thus informing a user of the defect.

On the other hand, when the converted value (S) of the short electrode 333 is smaller than the reference value (N), it is determined that the amount of water in the case 310 of the steam generator 300 is sufficient and the steam generator 300 can be operated without additional supply of water (S240). This state is illustrated in FIG. 11.

Then, the controller 400 closes the water supply valve 200 and turns the heater 320 on (S250), thereby operating the steam generator 300 so that steam is supplied to a drum of the washing machine.

The sensing of the water level in the case 310 using the water level sensor 330 is continuously performed during the operation of the steam generator 300, i.e., during the generation of heat from the heater 320.

The above operation of the steam generator 300 is continuously performed until the operation of the washing machine using steam is terminated. During the above operation, when the converted value (L) of the long electrode 332 is larger than the reference value (N), as shown in FIGS. 7 and 8, the operation of the heater 320 is forcibly stopped even if the operation of the washing machine using steam is not terminated (S260), and then water is additionally supplied to the steam generator 300.

During the above operation of the steam generator 300, the water level sensor 330 may be out of order. In this case, the water level in the case 310 is lowered lower than the height of the heater 320 and the heater 320 is superheated, thus causing many problems.

Accordingly, preferably, the controller 400 counts the time during the operation of the steam generator 300.

That is, most preferably, when the converted value (L) of the long electrode 332 does not vary although the heat generating time of the heater 320 exceeds a designated time set from a point of time, when water is finally supplied to the steam generator 300, the operation of the heater 320 is stopped so that the generation of heat from the heater 320 is stopped.

Here, the designated time is a time to lower the water level in the case 310 to a position at which the terminal of the long electrode 332 is located, when the heater 320 generates heat under the condition that the water level in the case 310 reaches the full water level, and was obtained from conventional experiments.

The heat generating time of the heater 320 is the total of time during the turning-on of the heater 320.

Particularly, it is possible to confirm whether or not the water level sensor 330 is defective through the above series of the processes.

That is, when the converted value (L) of the long electrode 332 does not vary until the heat generating time exceeds the designated time, it is determined that the water level sensor 330 is defective.

Preferably, when the defect of the water level sensor 330 is detected, an error message indicating the defect of the water level sensor 330 is displayed on the display unit 520, thus informing a user of the defect.

During the supply of water to the steam generator 300 and during the operation of the steam generator 300, the converted values (L and S) of the long electrode 332 and the short electrode 333 vary.

For example, during the supply of water to the steam generator 300, the converted value (L) of the long electrode 332 may become smaller than the reference value (N) before the converted value (S) of the short electrode 333 becomes smaller than the reference value (N).

Thereby, a point of time when the generation of heat from the heater 320 can be controlled may be confused. This point of time is programmed for controlling the steam generator 300.

In the embodiment of the present invention, the process for supplying water to the steam generator 300 and the process for generating heat from the heater 320 are distinguished from each other. Accordingly, when the water supplying process is performed, the supply of water is controlled using the converted value (S) of the short electrode 333 regard lower of the variation of the converted value (L) of the long electrode 332, and when the heat generating process is performed, the generation of heat is controlled using the converted value (L) of the long electrode 332 regard lower of the variation of the converted value (S) of the short electrode 333.

That is, during the supply of water, although the converted value (L) of the long electrode 332 becomes smaller than the reference value (N), the heater 302 does not generate heat, and, during the generation of heat, although the converted value (S) of the short electrode 333 becomes larger than the reference value (N), the supply of water is not performed.

Thereby, it is possible to prevent an error occurring during the supply of water or the generation of heat in the operation of the washing machine.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention provides a washing machine having a steam generator, which generates steam so that the steam is used in a washing or drying operation, and a method for controlling the same.

In the washing machine and the method for controlling the same of the present invention, it is possible to correctly measure the amount of water existing in the steam generator.

That is, since a current water level is correctly detected using voltage values of respective electrodes sensed by a water level sensor, a water supply valve and a heater are correctly controlled.

Particularly, although the water level sensor is out of order, the supply of water or the generation of heat is automatically stopped according to the total water supply time or the total heat generating time, thereby improving the stability of the steam generator.

The invention claimed is:

1. A washing machine or a drying machine comprising:

a steam generator having a heater and a water level sensor; and a controller to control the heater according to a counted time period and a water level of the steam generator, wherein the controller:

turns on the heater when a water supply to the steam generator supplies water for a first predetermined counted time period, and turns on the heater when the water level sensor senses that the water level is at a first predetermined water level until the water supply time exceeds the first predetermined counted time period.

2. The machine as set forth in claim 1, wherein the controller turns off the heater when a heater-operating time reaches an end of a second predetermined time period.

3. The machine as set forth in claim 2, further comprising a warning device which is activated when the first count reaches the end of the first predetermined time period or a second count reaches the end of the second predetermined time period.

4. The machine as set forth in claim 1, wherein the controller causes the heater to turn off when the water level sensor senses that the water level is at a second predetermined water level until the heater-operating time exceeds a second predetermined time period.

5. The machine as set forth in claim 4, wherein the second predetermined water level is a water level at which a surface of the heater is exposed out of the water.

6. The machine as set forth in claim 1, further comprising a water supply valve to supply water to the steam generator, wherein the controller causes the water supply valve to shut off when a count reaches an end of a predetermined time.

7. The machine as set forth in claim 6, wherein the controller causes the water supply valve to shut off when the water level reaches a predetermined water level.

8. A washing machine or a drying machine comprising:

a steam generator having a heater and a water level sensor; and a controller to control the operation of the heater, wherein the controller causes the heater to:

turn on when the water level sensor senses that the water level is at a first predetermined water level until a first count for supplying water to the steam generator reaches a first predetermined time period, and turn on when the first count has reached an end of the first predetermined time period in case that the water level sensor malfunctions or is out of order.

9. The machine as set forth in claim 8, wherein the controller causes water to be prevented from being supplied to the steam generator when the water level sensor senses that the water level is at the first predetermined water level or the first count has reached an end of the first predetermined time period.

10. The machine as set forth in claim 8, wherein the water level sensor comprises:

a long electrode, which is exposed at the second predetermined water level;

a common electrode, which is exposed at or below the second water level; and a short electrode, which is exposed at the first predetermined water level.

11. The machine as set forth in claim 8, further comprising a water supply valve to supply water to the steam generator, wherein the controller causes the water supply valve to shut off when the water level reaches a predetermined water level.

12. The machine as set forth in claim 11, wherein the controller causes the water supply valve to shut off when a count reaches an end of a predetermined time period.

13. A washing machine or a drying machine comprising:

a steam generator having a heater and a water level sensor; and a controller to control the operation of the heater, wherein the controller causes the heater to:

turn off when the water level sensor senses that the water level is at a first predetermined water level until a heater-operating time reaches an end of a first predetermined time period, and turn off when the heater-operating time has reached an end of the first predetermined time period.

14. The machine as set forth in claim 13, wherein the controller causes water to be supplied to the steam generator when the water level sensor senses that the water level is at the first predetermined water level or the heater-operating time has reached an end of the first predetermined time period.

* * * * *